US009289973B2

(12) United States Patent
Stefani et al.

(10) Patent No.: US 9,289,973 B2
(45) Date of Patent: Mar. 22, 2016

(54) TRANSFER DECORATING MACHINE AND METHOD FOR TRANSFERRING AN IMAGE

(71) Applicant: SYSTEM S.P.A., Fiorano Modenese (IT)

(72) Inventors: Franco Stefani, Sassuolo (IT); Carlo Antonio Camorani, Roteglia di Castellarano (IT)

(73) Assignee: SYSTEM S.P.A., Fiorano Modenese (IT)

( * ) Notice: Subject to any disclaimer, the term of this patent is extended or adjusted under 35 U.S.C. 154(b) by 0 days.

(21) Appl. No.: 14/427,550

(22) PCT Filed: Sep. 18, 2013

(86) PCT No.: PCT/IB2013/058632

§ 371 (c)(1),
(2) Date: Mar. 11, 2015

(87) PCT Pub. No.: WO2014/045208

PCT Pub. Date: Mar. 27, 2014

(65) Prior Publication Data

US 2015/0239236 A1 Aug. 27, 2015

(30) Foreign Application Priority Data

Sep. 20, 2012 (IT) ..... MO2012A0224

(51) Int. Cl.
*B41J 2/005* (2006.01)
*B28B 11/00* (2006.01)
(Continued)

(52) U.S. Cl.
CPC ..... *B41J 2/0057* (2013.01); *B05C 1/0813* (2013.01); *B05C 1/14* (2013.01); *B28B 11/001* (2013.01);
(Continued)

(58) Field of Classification Search
CPC ..... B41J 2/0057; B28B 11/001
See application file for complete search history.

(56) References Cited

U.S. PATENT DOCUMENTS 5,520,738 A * 5/1996 Aindow et al. ..... 118/621
8,337,947 B2 12/2012 Camorani
2004/0101619 A1* 5/2004 Camorani ..... 427/180
(Continued)

FOREIGN PATENT DOCUMENTS

IT 1314624 10/2001
JP 2001100546 4/2001
(Continued)

*Primary Examiner* — Kristal Feggins
*Assistant Examiner* — Kendrick Liu
(74) *Attorney, Agent, or Firm* — Pearne & Gordon LLP

(57) ABSTRACT

A transfer decorating machine that utilizes powdered material or granules comprises: a mobile rest surface (10), on which the objects to be decorated are translated according to a predetermined direction; a device for the application of a decoration, operating above the mobile rest surface (10) and provided with a mobile transfer belt (3), which is a closed loop between movement rollers (2, 20) having mutually parallel axes, and serves the function of receiving a decoration realized with powdered material or granules (9) and then transferring it on objects to be decorated. Said device comprises a first unit (100) suitable for composing a decoration on the transfer belt (3) and a second unit (200) that carries out the transfer of the decoration from the transfer belt (3) onto an object to be decorated. The transfer belt (3) is commanded to move in a direction concordant with that of the mobile rest surface (10). The second unit (200) comprises a section located in the lower part of the transfer belt (3) that has the external side thereof facing downwards and facing, at a predetermined distance, a surface to be decorated (11) of an object lying on the mobile rest surface (10). This section extends between a curved surface of an abutment (17, 2) and a movement roller (20). There are means operating correspondingly on the internal side of the said section of the transfer belt (3) to direct jets of air towards it, said jets of air generating a situation of turbulence.

18 Claims, 5 Drawing Sheets

(51) Int. Cl.

| | |
|---|---|
| ***B28B 11/04*** | (2006.01) |
| ***B41M 5/025*** | (2006.01) |
| ***G03G 15/34*** | (2006.01) |
| ***G03G 15/00*** | (2006.01) |
| ***B05C 1/08*** | (2006.01) |
| ***B05C 1/14*** | (2006.01) |

(52) U.S. Cl.
CPC ..... *B28B 11/047* (2013.01); *B41M 5/0256* (2013.01); *G03G 15/344* (2013.01); *G03G 15/6591* (2013.01)

(56) References Cited

U.S. PATENT DOCUMENTS

| | | | | |
|---|---|---|---|---|
| 2005/0277050 | A1 | 12/2005 | Yamazaki et al. | |
| 2009/0010682 | A1 | 1/2009 | Camorani | |
| 2010/0221449 | A1 * | 9/2010 | Schlatterbeck et al. | 427/558 |

FOREIGN PATENT DOCUMENTS

| | | | | |
|---|---|---|---|---|
| WO | WO 9518020 | A2 * | 7/1995 | B44C 1/04 |
| WO | 2005025828 | A1 | 3/2005 | |
| WO | 2007096746 | A2 | 8/2007 | |

* cited by examiner

TRANSFER DECORATING MACHINE AND METHOD FOR TRANSFERRING AN IMAGE

A transfer decorating machine that utilises powdered material or granules constitutes the object of the present invention.

Specifically, but not exclusively, the invention finds application in the decoration of ceramic articles such as ceramic tiles.

There are known decorating systems which comprise preforming on a transfer belt, or surface, an image constituted by liquid ejected from inkjet apparatuses, having the decorating material in powdered form or granules adhere to this image (hence the name "dry" decorating) and then transferring the decoration thus obtained onto the receiving surface of the object being decorated.

Compared to traditional inkjet technologies, systems such as these offer the significant advantage of eliminating all risk of possible blockage and wear of the delicate inkjet apparatuses, given that the decorating material does not pass through the inkjet apparatus, which only operates with simple liquids that are free of suspensions of solids even if consisting of fine particles.

Moreover, in this manner granular or powdered decorating materials can be utilised, with a very broad range of choice as regards materials and aesthetic results.

In particular, the invention lies within the category of decorating or transfer printing technologies identified previously herein as the "dry" decorating type, in which electrostatic or electrographic techniques are not employed in any manner whatsoever to bring about adhesion of the granular or powdered decorating materials to the transfer support—where the image to be transferred is formed and from which the transfer of this image onto the receiving surface of the object being decorated is subsequently carried out. Electrostatic techniques, which are well known for numerous types of applications, normally require a specific treatment of the powdered or granular decorating material and the addition of special components that in most cases have non-negligible polluting characteristics.

In systems that do not utilise electrostatic or electrographic techniques, the transfer of a decoration from the transfer surface to the receiving surface of the object to be decorated surely represents a very delicate moment on which the goodness of the final result depends, as regards the fidelity and precision of the reproduction.

Examples of such transfer systems are described in IT1314624, WO2005025828 and WO2007096746.

One way of transferring a decoration to the receiving surface of an object to be decorated, consists in setting the section of the belt facing the receiving surface in rapid vibration.

With this aim, patent IT1314624 provides for using a vibrating piezoelectric actuator, in contact with the wall of the transfer belt opposite the wall on which the decoration to be transferred is found.

A system such as this requires an apparatus that is costly, cumbersome and has considerable levels of energy consumption. Moreover, it does not permit efficient transfer of energy to the belt, unless considerable pressure is maintained in the contact zone, thereby causing rapid wear of the belt, and, in many cases, early breakage.

In WO2005025828, the use of a doctor blade is comprised for detachment of the decoration from the transfer surface; in this case, numerous drawbacks are noted owing to wear in the contact zones, soiling of the doctor blade and imprecision of the image.

In WO2007096746, the use of rapid localised heating in the proximity of the transfer zone is comprised for detachment of the decoration from the transfer surface. This system also requires considerable energy as with each rotation, the transfer surface undergoes a heating and cooling cycle, and this also entails limits affecting operation speeds. Moreover, there are also limits regarding the thermal and mechanical resistance of the materials constituting the transfer surface.

A drawback shared by these detachment systems consists in the imprecision of the image owing to the fact that the trajectories of the various particles begin at different points and also develop in different directions, as the initial drop velocity varies from one particle to the other.

This drawback is troublesome mainly in the case where one wishes to maintain a higher speed of the transfer surface with respect to the speed of the receiving surface, for the purpose of enabling the application of greater amounts of decorating material.

The aim of the invention is to overcome the described shortcomings and drawbacks of the prior art by means of a machine as described and claimed below.

The invention also concerns a method for transferring an image to a receiving surface comprising the following steps:
forming an image on the external side of a transfer surface or mobile transfer belt;
moving the transfer surface or mobile transfer belt, with the internal surface thereof resting on a support, towards a zone for detachment from the transfer surface or belt immediately downstream of the said support so as to bring about the gradual detachment of the image along a line where the rest and the contact with said support end.

Further characteristics and advantages of the invention will become more apparent from the detailed description of some preferred, but not exclusive embodiments of the invention, as illustrated by non-limiting example in the accompanying figures, in which.

Figure 1:
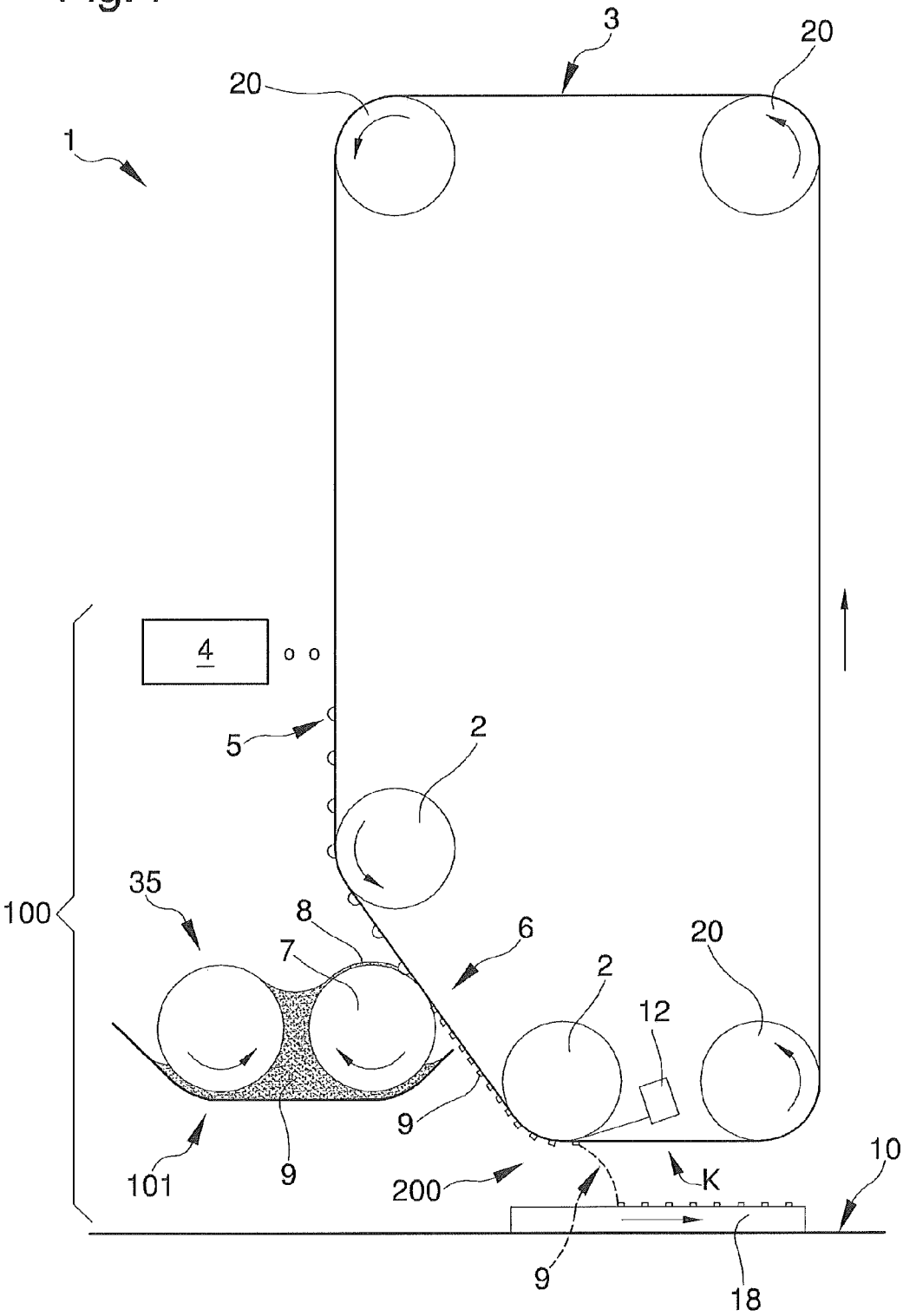
FIG. 1 is a schematic frontal overall view of the invention in vertical elevation.

With reference to the figures cited, 1 indicates, in its entirety, a transfer decorating machine that utilises powdered material or granules comprising:

- a mobile rest surface 10 on which the objects to be decorated are translated in a predetermined direction;
- a device for the application of a decoration, operating above the said mobile rest surface 10 and provided with a mobile transfer belt 3, consisting of a tubular film, which is a closed loop extending between movement rollers 2, 20 having mutually parallel axes, and serves the function of receiving a decoration realised with powdered material or granules 9 and then transferring it on objects to be decorated.

Said device comprises, in turn, a first unit 100 suitable for composing a decoration on the mobile transfer belt 3 and a second unit 200 suitable for carrying out the transfer of the said decoration from the mobile transfer belt 3 onto at least one object to be decorated. The mobile transfer belt 3 is commanded to move in a direction concordant with that of the mobile rest surface 10.

The composition of the decoration to be transferred is realised on the external surface of the transfer belt 3 at a first vertical descending section thereof and in a subsequent inclined section 6 thereof.

An inkjet apparatus 4 suitable for forming an image 5 on the external surface of the transfer belt 3 is located close to the first vertical section.

A rotor 7 is arranged at the subsequent inclined section 6, with slight interference on the film 3, which constitutes the transfer belt 3, and the rotor 7 is kept coated with a layer 8 of powdered material or granules 9. To decorate the section 6, the layer 8 adheres to the image 5 previously formed on the external surface of the transfer belt 3.

In the second unit 200, a section of the transfer belt 3 is identifiable in the lower part thereof. The external side of the section is facing downwards and facing, at a predetermined distance, a surface to be decorated 11 of an object lying on the mobile rest surface 10. In this regard, it should be pointed out that the same mobile rest surface 10 can be utilised to receive a decoration that will then be transferred to further objects to be decorated. In this case, the rest surface 10 would be utilised as an additional transfer belt.

Specific means operate in said section on the internal side of the transfer belt 3 to direct jets of gas towards said internal side. Specifically, these are jets of air that are arranged according to an array transversal to the transfer surface or mobile belt 3. The jets are produced by nozzles 13 arranged in an array along a transversal direction with respect to the direction of advancement Y of the transfer surface or mobile belt 3 and are individually oriented with their axes X having an inclination differing from zero with respect to the direction of the advancement movement of the transfer belt 3. As indicated previously, the nozzles 13 are oriented directly towards the internal side of the transfer belt 3.

The components of the velocity of the jets are parallel, but with an opposite direction with respect to the speed of the advancement movement of the section of the transfer belt 3.

The angle of incidence W of the direction of the jets with respect to the direction of the speed of the said section of the transfer belt is preferably within the range of 15° to 45°.

The nozzles 13, from which the jets of air are emitted, are preferably afforded in a wall of a tubular profile 12.

Figure 2:
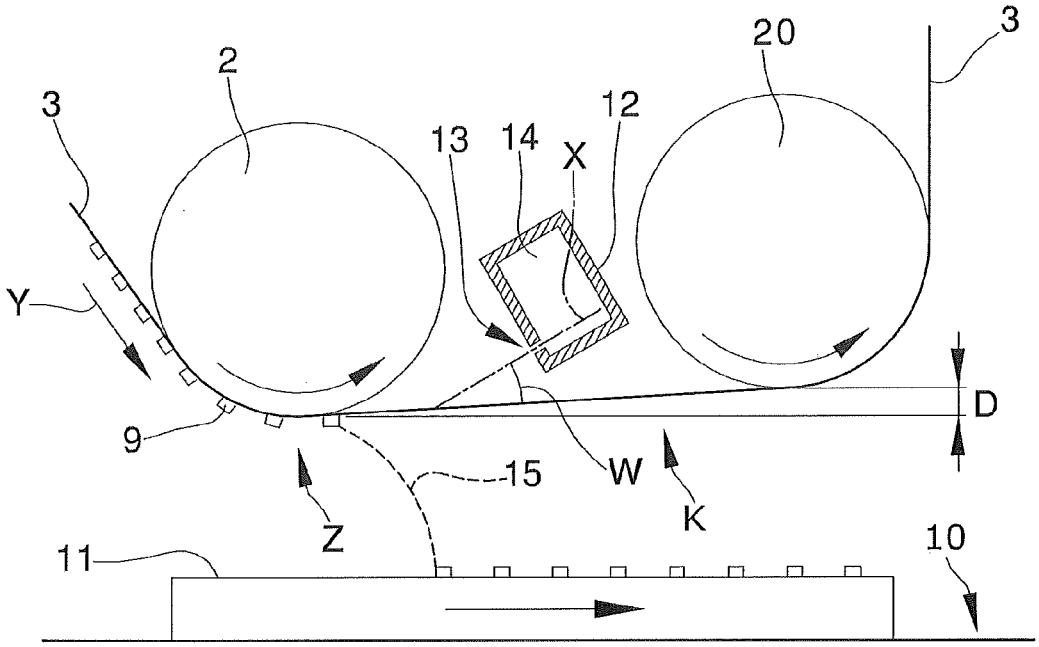
FIG. 2 is a partially sectioned view of part of the view appearing in FIG. 1, on an enlarged scale.

Referring particularly to FIG. 2, the nozzles 13 are holes afforded in a tubular profile 12 having a rectangular cross-section.

This array of nozzles 13 is located in a position close to the lower corner of the profile 12.

The profile is closed and it is provided with an inner chamber 14 kept under pressure by unillustrated means.

A turbulent flow of air flows out from the array of nozzles 13, which results in setting into vibration the section of the transfer belt 3 comprised between the two lower rollers 2, 20. The adherent powdered or granular material 9 on the transfer belt or film 3 in the inclined section is induced to become detached as soon as the transfer belt or film 3 passes the line of tangency indicated by the generatrix Z on the lower roller 2.

Upon detachment, the powdered or granular material 9 starts to drop with a drop velocity near zero and travels along a parabolic trajectory 15 that is substantially identical for all the particles. In this manner, in addition to obtaining extremely precise positioning of the particles, inaccuracy caused by shifts due to the high velocity of impact on the receiving surface 11 is also prevented. In fact, in practice it has been found that substantial differences are not perceived between an image formed on a non-adhesive surface 11 and the same image formed on an adhesive surface 11.

Figure 3:
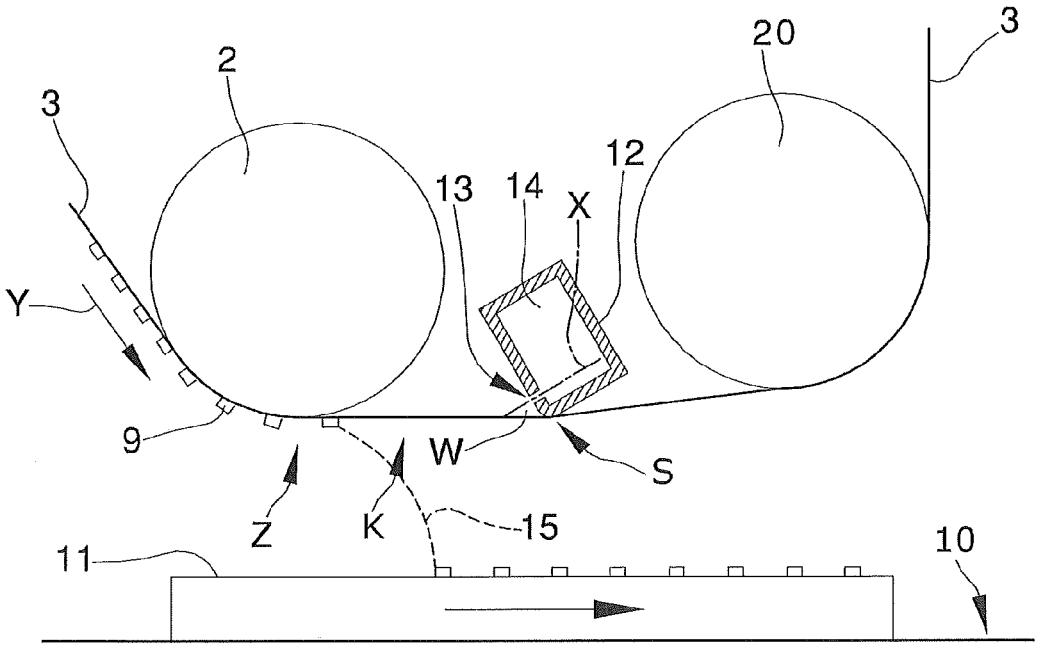
FIG. 3 is the same view as that appearing in FIG. 2, but referring to a second embodiment.

A further advantage is evident when working with a speed of advancement of the transfer belt 3 that is higher than that of the receiving surface 11, as illustrated in FIG. 3. Even with a speed ratio of 5:1 (e.g. transfer belt or film 3 at 30 m/min; receiving surface 11 at 6 m/min), optimal image sharpness is achieved, with the images taking on a concrete appearance of a bas-relief effect, given that the thickness of the powders or granules 9 deposited on the receiving surface 11 will be 5 times greater than the layer present on the transfer belt 3.

To achieve maximum precision, it is convenient that the amplitudes of oscillation of the film, which constitutes the transfer belt 3, be as contained as possible, though keeping acceleration high, so that, by force of inertia, the material can be easily detached. This can be achieved by: lightening the weight of the film constituting the transfer belt 3, increasing the tension and reducing the length of the oscillating section. For this purpose, as illustrated in FIGS. 3 and 4, the reduction of the oscillating section K is obtained by sliding the internal surface of the film constituting the transfer belt 3 on an abutment, which, in this specific case consists in the lower corner S of the profile 12.

In addition to increasing the precision of the trajectory 15 along the drop path, these measures reduce the start zone of these trajectories even further, pursuant to the higher oscillation frequency.

Figure 4:
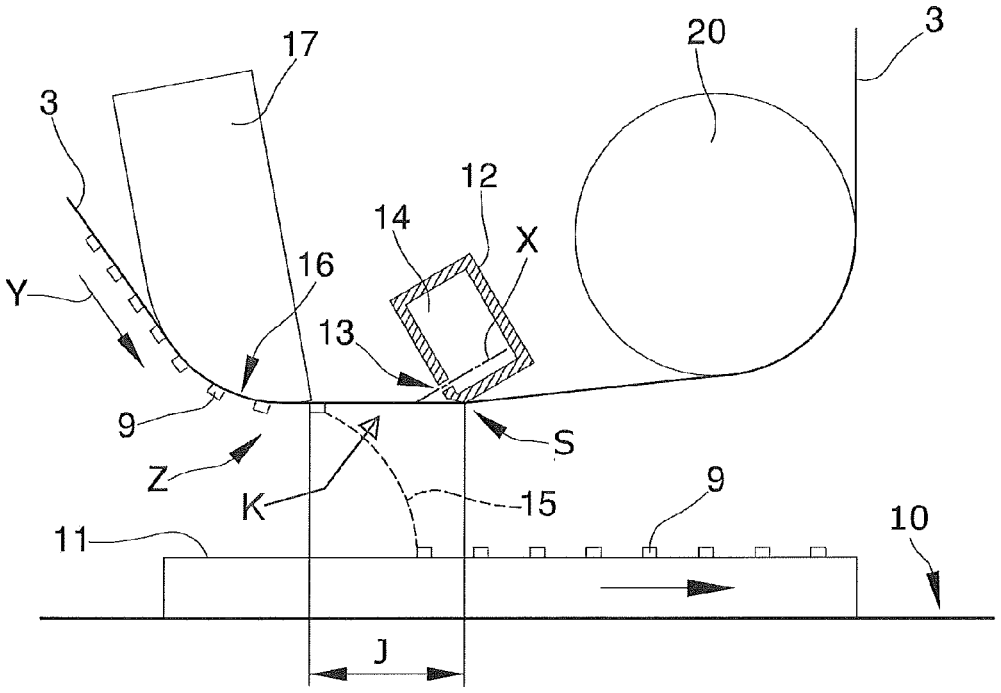
FIG. 4 is the same view as that appearing in FIGS. 2 and 3, but referring to a further embodiment.
Figure 5:
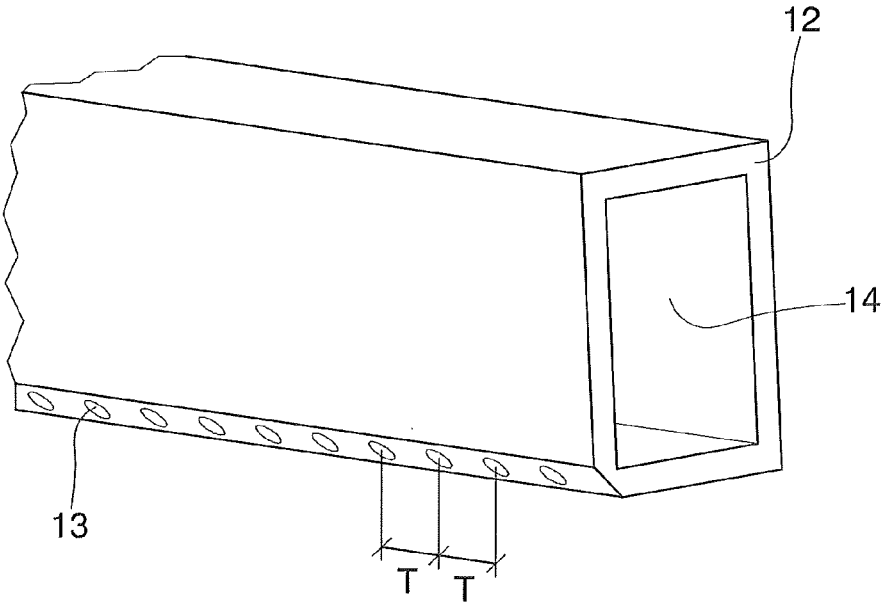
FIG. 5 is a perspective view of a part appearing in FIG. 4.

In the embodiment appearing in FIG. 4, the said section of the transfer belt 3 extends between a curved surface 16 of a fixed abutment 17 and the corner S of a tubular profile 12.

The nozzles 13 are afforded in the proximity of the corner S of the said tubular profile 12, which is supplied with compressed air.

The corner S is tangent to the transfer belt 3 and defines a portion of a section of the transfer belt 3 marked by the letter K, the length J of which is thus quite limited and it can thus vibrate more effectively at a higher frequency and with a smaller amplitude.

Referring again to the embodiment illustrated in FIG. 4, there is identified a detachment line, constituted by the generatrix Z, where the rest and the contact on the support 17 of the transfer belt 3 end and where the controlled detachment of the powdered material or granules 9 adhering to the image 5 created on the external surface of the transfer belt 3 in the first unit 100 takes place.

In this case as well, the action of the jets of air emitted from the nozzles 13 arranged in an array is essentially that of generating a situation of turbulent motion, the effect of which is that of inducing a vibration on the relative section of the transfer belt 3, which is constituted by a thin film, thereby forcing the powdered or granular decorating material 9 to become detached from the transfer belt or film 3 and deposit on the receiving surface 11.

In fact, the vibration induced on the transfer belt 3 section involved suffices to cause the detachment of the powdered or granular material 9 therefrom. Moreover, detachment takes place in a "controlled" manner because it takes place at the generatrix (the line Z for the abutment 17) of the curved surface, that is, at the start of the detachment of the transfer belt 3.

The version with the abutment 17 appearing in FIG. 4 also enables application of maximum turbulence precisely in the proximity of the detachment line Z. This effect can be further increased in the (unillustrated) case in which the nozzles 13 are positioned immediately downstream of the abutment 17 with a perpendicular orientation X with respect to the transfer belt 3.

The motion of the transfer belt 3 at this generatrix Z is substantially in a horizontal direction, so that the powdered or granular material 9 begins to detach with a vertical drop velocity near zero and starts to travel along a parabolic trajectory 15.

The pressure induced by the ejectors and the vibration of the transfer belt 3 can create a certain lowering of the film, which constitutes the transfer belt 3, in the intermediate zone between the rollers 2, 20.

To avoid interferences in this intermediate zone, it is thus advantageous that the roller 20 downstream be raised higher than the roller 2 upstream by a certain amount D.

Figure 6:
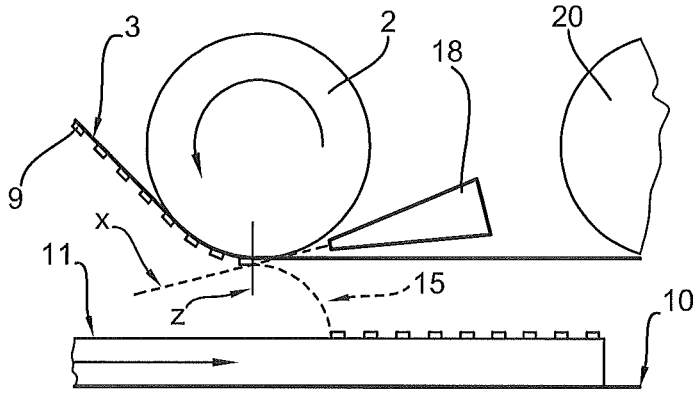
FIGS. 6, 7 and 8 are the same type of view appearing in FIGS. 2 and 3, but representing three further embodiments.

As illustrated in FIG. 6, the tubular profile 18 has a cross-section in the form of an isosceles triangle and the holes are afforded in the sharpest corner in a direction perpendicular to the shortest side. In this manner, the position of the jet of air is brought as close as possible to the detachment line Z so as to obtain greater efficiency.

Figure 7:
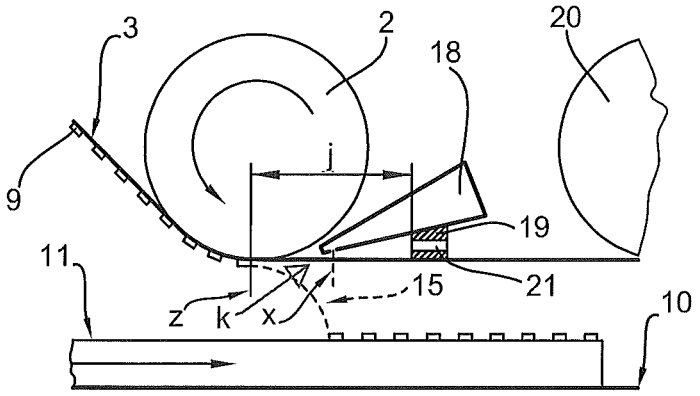

In FIG. 7, the tubular profile 18 has a triangular cross-section like that appearing in FIG. 6, and the array of holes therein are afforded in proximity to the vertex angle on the lower wall, with the direction X of the jets directed downwards, perpendicularly to the transfer belt 3.

The lower wall of the tubular profile 18 has a protrusion 19 serving as an abutment for the transfer belt 3 so as to reduce the length J of the vibrating section. Through holes 21 suitable for enabling the passage of the air ejected from the nozzles 13 are present in the thickness of the protrusion 19.

The nozzles 13 may be of the most varied dimensions, depending on their interaxis, operating pressure, the type of film constituting the transfer belt 3, operating speed, the nature of the decorating material and so on.

By way of example, excellent results are achieved with:

- a film constituting the transfer belt 3 that is made of low-density polyethylene, electrically conductive, having a thickness of 0.05 mm, a length of the oscillating section of 30 mm and an advancement speed of 10 m/min;
- a profile 12 of external dimensions of 15×15 mm, wall thickness of 1.5 mm, holes 13 of a diameter of 0.35 mm, interaxis T of 7.5 mm between holes, internal operating pressure of 1.1 bars, angle W of incidence of 20°, direction on the line of tangency Z, distance of nozzle/line of tangency Z equal to 20 mm;
- decorating material made by the Vetriceramici firm of Casola Valsenio (RA), type: ASS 106/P153, with particles of a diameter ranging from 0.045 mm to 0.150 mm.

Figure 8:
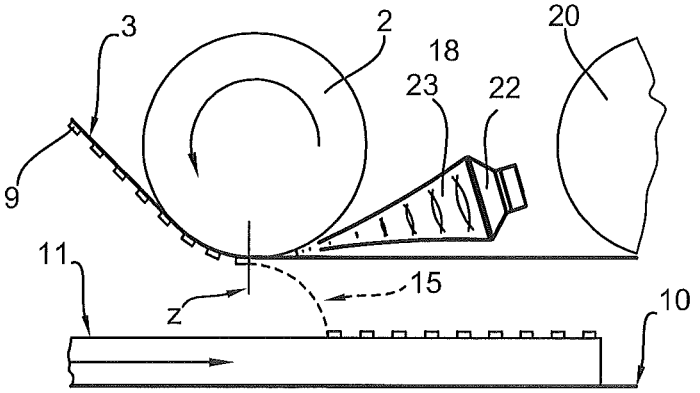

In a different version of the invention, as illustrated in FIG. 8, the vibration is transmitted to the transfer belt 3 by means of an actuator constituted by a loudspeaker 22 coupled to a conveyor 23 of sonic/ultrasonic waves, suitable for concentrating the energy along the detachment line Z.

Figure 9:
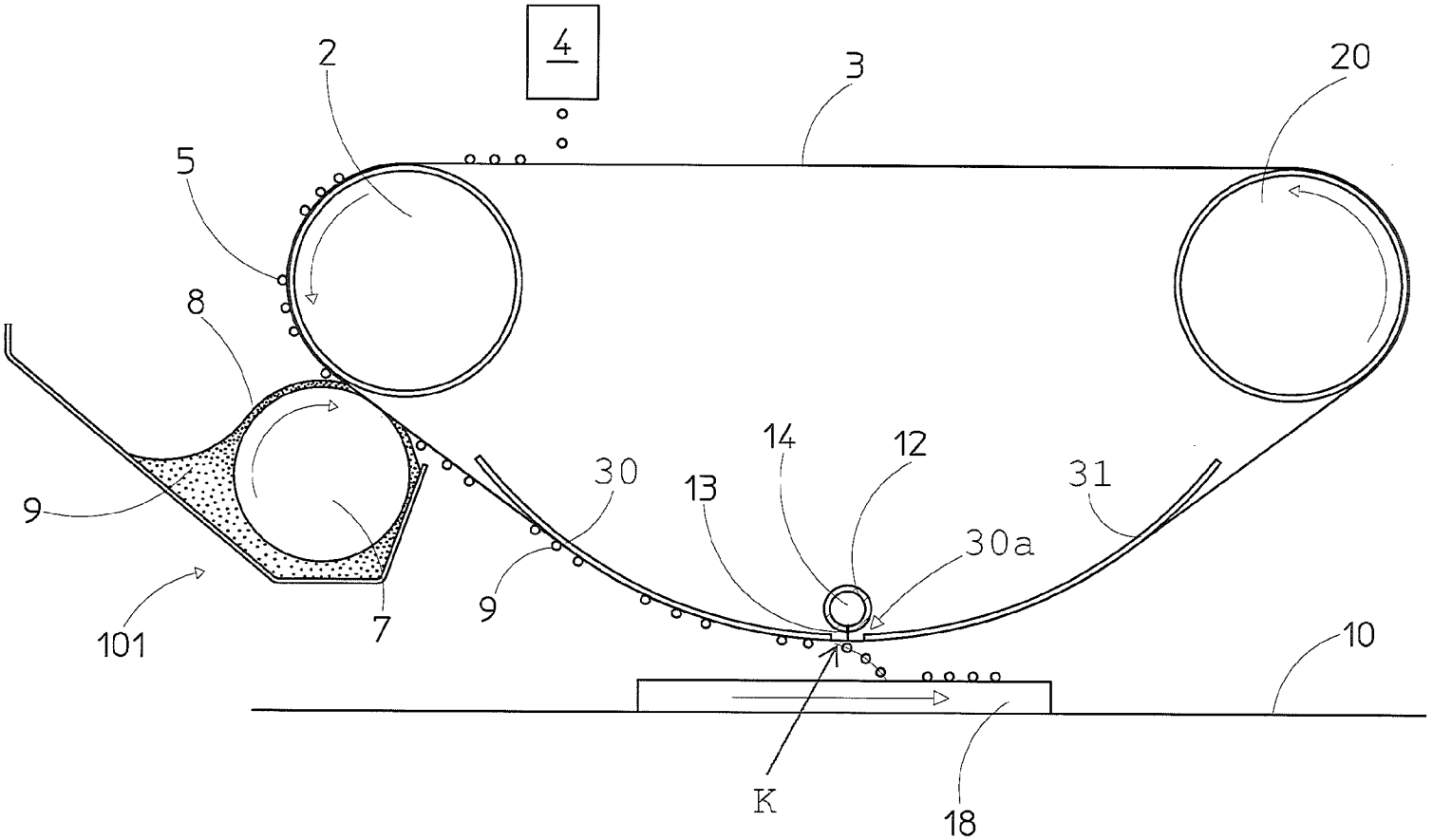
FIG. 9 is a schematic frontal overall view, in vertical elevation, of a further embodiment of the decorating machine according to the present invention.

In the version appearing in FIG. 9, the path traveled by the transfer belt 3 is supported in the lower section by an abutment 30, 31, on which the belt slides in permanent contact therewith. This abutment 30, 31 comprises a first curved section 30 and a second curved section 31, which are set close to each other so as to delimit a slot 30*a*, on which the lower section K of the transfer belt 3 is arranged. As can be seen in FIG. 9, the transfer belt 3 slides in permanent contact over the abutment 30, 31, but not at the slot 30*a* positioned in the lowest part. The first and the second curved section 30, 31 preferably have a radius of curvature, in a plane containing the direction of advancement of the belt 3 that is equal and perpendicular to the belt 3.

In this version, one advantage is provided by the fact that the belt, in the section approaching the decoration detachment zone, travels along a trajectory with a very wide radius that minimises the effects of the centrifugal force. Moreover, as it remains firmly coupled to the surface of the abutment 30, 31, the belt 3 is not subject to vibrations up to the detachment line Z. Another advantage of this configuration is that of enabling the realisation of an oscillating section K that can also be very limited, and enabling maximum freedom for positioning of the actuator 14. For example, it is possible to orient the jet of air perpendicularly to the belt and in a position very close to the detachment line Z.

A further advantage is derived from the symmetrical form of the abutment 30, 31 with respect to the axis of the slot 30*a*; this makes it possible to configure the printing direction of the machine, reversing the direction of rotation of the belt 3, with a minimum of intervention for changes.

In a further version, which is not represented herein, a series of loudspeakers 22 in an array are facing out with their membranes being at a short distance from the transfer belt 3, thereby being able to transmit the vibration to the transfer belt 3 effectively. One advantage of this system of acoustic vibration lies in the fact that flows of air are not created.

In a further unillustrated version, the turbulence for inducing vibration on the transfer belt 3 is obtained with ventilating means constituted for example by small brushless axial fans in an array in the proximity of the internal wall of the transfer belt 3. These fans may possibly be isolated inside a closed chamber, one wall of which will be substantially defined by the transfer belt 3, and thereby preventing outflows of air.

The invention claimed is:

1. A transfer decorating machine (1) that utilises powdered material or granules (9) comprising:

- a rest surface (10) that is mobile in a predetermined direction;
- a device for the application of a decoration, operating above the said rest surface (10) and provided with a mobile transfer belt (3), which is a closed loop between movement rollers (2, 20), and serves the function of receiving a decoration realised with powdered material or granules (9) and transferring the decoration towards said rest surface (10), said device comprising a first unit (100) suitable for composing one said decoration on the transfer belt (3) and a second unit (200) suitable for carrying out the transfer of the said decoration from said transfer belt (3), said mobile transfer belt (3) being commanded to move in an advancement direction (Y), wherein said second unit (200) comprises a lower section (K) of the said transfer belt (3) that has the external side thereof facing downwards and facing said mobile rest surface (10); said section (K) extending between a first abutment (2, 17, 30) arranged upstream and a second abutment (S, 19, 20, 30) arranged downstream; there being provided actuator means (12, 13, 14, 18, 22, 23) operating on the internal side of the said section (K) and suitable for rapidly moving a gas present in the proximity of the said section (K) and for transmitting a vibration to the said section (K) by means of the said gas, characterized in that said actuator means (12, 13, 14, 18, 22, 23) comprise jets of gas arranged in an array transversal to the advancement direction (Y) of the mobile transfer belt (3) and suitable for generating a situation of turbulent motion.

2. The machine according to claim 1, characterised in that said jets are produced by nozzles (13) arranged in an array along a transversal direction with respect to the direction of advancement (Y) of the mobile transfer belt (3) and are individually oriented with their axes (X) towards said internal side of the said section (K).

3. The machine according to claim 2, characterised in that said jets are directed towards the line (Z) where the contact between said abutment (2, 17) and said section (K) ends.

4. The machine according to claim 2, characterised in that said jets are directed perpendicularly against the internal side of the said section (K).

5. The decorating machine according to claim 2, characterised in that said nozzles (13) are afforded in a wall of a tubular profile (12).

6. The decorating machine according to claim 5, characterised in that said nozzles (13) are afforded in the proximity of a corner (S) of the said tubular profile (12).

7. The decorating machine according to claim 5, characterised in that said tubular profile (12) has the nozzles arranged along a sharp corner, which is inserted in a wedge-shaped space defined by the roller (2) and by the internal surface of the said section (K).

8. The decorating machine according to claim 5, characterised in that said second abutment (S, 19) is integrated in said tubular profile (18).

9. The decorating machine according to claim 1, characterised in that the said first abutment consists of a fixed abutment (17) provided with a curved sliding surface whereon it is provided that the transfer surface of the mobile belt (3) slides; said curved sliding surface being delimited by a detachment line that identifies the line (Z) where the rest and the contact on the support (17) of the transfer belt (3) end.

10. The decorating machine according to claim 1, characterised in that the said first abutment consists of a said movement and abutment roller (2).

11. The decorating machine according to claim 1, characterised in that the said second abutment consists of a said movement roller (20).

12. The decorating machine according to claim 1, characterised in that the first abutment comprises a first curved section (30); the second abutment comprises a second curved section (31); said first and second curved sections (30, 31) are set close to each other so as to delimit a slot (30*a*) on which the lower section (K) of the transfer belt (3) is arranged.

13. The decorating machine according to claim 1, characterised in that said actuator means comprise generators (22) of sonic and/or ultrasonic waves.

14. The decorating machine according to claim 13, characterised in that said actuator means comprise conveyors (23) of sonic and/or ultrasonic waves.

15. The decorating machine according to claim 1, characterised in that said actuator means comprise ventilating means.

16. The decorating machine according to claim 1, characterised in that said gas is air.

17. A method for transferring an image to a receiving surface (11) comprising the following steps:

forming said image on an external surface of a mobile transfer belt (3);

moving the transfer belt (3), with an internal surface thereof resting against an abutment (2, 17), towards a detachment zone of the said transfer belt (3) present downstream of the said abutment (2, 17) so as to bring about the gradual detachment of the said image along a line (Z) where the said rest on said abutment (2, 17) ends by jets of gas operating on the internal side of said mobile transfer belt (3) and arranged according to an array transversal to an advancement direction (Y) of said mobile transfer belt (3) and suitable for generating a situation of turbulent motion.

18. A transfer decorating machine (1) that utilises powdered material or granules (9) comprising:

a rest surface (10) that is mobile in a predetermined direction;

a device for the application of a decoration, operating above the said rest surface (10) and provided with a mobile transfer belt (3), which is a closed loop between movement rollers (2, 20), and serves the function of receiving a decoration realised with powdered material or granules (9) and transferring the decoration towards said rest surface (10), said device comprising a first unit (100) suitable for composing one said decoration on the transfer belt (3) and a second unit (200) suitable for carrying out the transfer of the said decoration from said transfer belt (3), said mobile transfer belt (3) being commanded to move in an advancement direction (Y), wherein said second unit (200) comprises a lower section (K) of the said transfer belt (3) that has the external side thereof facing downwards and facing said mobile rest surface (10); said section (K) extending between a first abutment (2, 17, 30) arranged upstream and a second abutment (S, 19, 20, 30) arranged downstream; there being provided actuator means (12, 13, 14, 18, 22, 23) operating on the internal side of the said section (K) and suitable for rapidly moving a gas present in the proximity of the said section (K) and for transmitting a vibration to the said section (K) by means of the said gas, characterized in that said actuator means (12, 13, 14, 18, 22, 23) comprise jets of gas produced by nozzles arranged in an array along a transversal direction with respect to the advancement direction (Y) of the mobile transfer belt (3), wherein the nozzles produce jets of the gas that are inclined at an angle of incidence (W) with respect to the advancement direction (Y).

* * * * *